US010892538B2

(12) United States Patent
Hanaoka

(10) Patent No.: US 10,892,538 B2
(45) Date of Patent: Jan. 12, 2021

(54) DIRECTIONAL COUPLER-INTEGRATED BOARD, RADIO-FREQUENCY FRONT-END CIRCUIT, AND COMMUNICATION DEVICE

(71) Applicant: Murata Manufacturing Co., Ltd., Nagaokakyo (JP)

(72) Inventor: Kunitoshi Hanaoka, Nagaokakyo (JP)

(73) Assignee: MURATA MANUFACTURING CO., LTD., Kyoto (JP)

( * ) Notice: Subject to any disclaimer, the term of this patent is extended or adjusted under 35 U.S.C. 154(b) by 0 days.

(21) Appl. No.: 16/375,864

(22) Filed: Apr. 5, 2019

(65) Prior Publication Data

US 2019/0237843 A1 Aug. 1, 2019

Related U.S. Application Data

(63) Continuation of application No. PCT/JP2017/038538, filed on Oct. 25, 2017.

(30) Foreign Application Priority Data

Oct. 27, 2016 (JP) ..... 2016-211008

(51) Int. Cl.
*H01P 5/18* (2006.01)

(52) U.S. Cl.
CPC ..... *H01P 5/184* (2013.01); *H01P 5/18* (2013.01)

(58) Field of Classification Search
CPC ..... H01P 5/18; H01P 5/184
(Continued)

(56) References Cited

U.S. PATENT DOCUMENTS 8,629,736 B2 * 1/2014 Tamaru ..... H01P 5/18 333/109
2004/0113716 A1 * 6/2004 Hilal ..... H01P 5/186 333/109

(Continued)

FOREIGN PATENT DOCUMENTS

JP 2011-250354 A 12/2011
JP 2012-105193 A 5/2012

(Continued)

OTHER PUBLICATIONS

Official Communication issued in International Patent Application No. PCT/JP2017/038538, dated Jan. 23, 2018.

*Primary Examiner* — Dean O Takaoka
(74) *Attorney, Agent, or Firm* — Keating & Bennett, LLP

(57) ABSTRACT

A coupler-integrated board includes a coupler, a first capacitor, a second capacitor, a resistance element, a matching circuit, and a multilayer circuit board. The coupler includes a main line and a secondary line. The first capacitor is connected in parallel with the secondary line. The second capacitor connects another end of the secondary line to a ground. The resistance element connects the other end of the secondary line to the ground. The resistance element has an impedance lower than a normalized impedance at a predetermined frequency. The matching circuit is connected between one end of the secondary line and a coupling port. The matching circuit matches an impedance at the coupling port to the normalized impedance at the predetermined frequency. The multilayer circuit board includes laminated base material layers. The coupler is integrated with the multiplayer circuit board.

20 Claims, 5 Drawing Sheets

(58) Field of Classification Search
USPC ..... 333/109–112, 116
See application file for complete search history.

(56) References Cited

U.S. PATENT DOCUMENTS

| | | | |
|---|---|---|---|
| 2012/0119846 | A1 | 5/2012 | Haruna |
| 2012/0161897 | A1 | 6/2012 | Tamaru et al. |
| 2013/0027273 | A1 | 1/2013 | Kuwajima et al. |
| 2017/0310355 | A1 | 10/2017 | Hayakawa |

FOREIGN PATENT DOCUMENTS

| | | | |
|---|---|---|---|
| JP | 2013-046305 | A | 3/2013 |
| WO | 2011/074370 | A1 | 6/2011 |
| WO | 2016/121455 | A1 | 8/2016 |

* cited by examiner

DIRECTIONAL COUPLER-INTEGRATED BOARD, RADIO-FREQUENCY FRONT-END CIRCUIT, AND COMMUNICATION DEVICE

CROSS REFERENCE TO RELATED APPLICATIONS

This application claims the benefit of priority to Japanese Patent Application No. 2016-211008 filed on Oct. 27, 2016 and is a Continuation Application of PCT Application No. PCT/JP2017/038538 filed on Oct. 25, 2017. The entire contents of each application are hereby incorporated herein by reference.

BACKGROUND OF THE INVENTION

1. Field of the Invention

The present invention relates to a directional coupler-integrated board with an integrated directional coupler, a radio-frequency front-end circuit including the directional coupler-integrated board, and a communication device including the directional coupler-integrated board.

2. Description of the Related Art

A configuration in which a capacitor is provided in parallel with a secondary line has been disclosed for a directional coupler (see, for example, Japanese Unexamined Patent Application Publication No. 2012-105193). With this configuration, an LC resonance circuit includes the inductance of each of a main line and the secondary line and the capacitance of the capacitor, with the result that a high degree of coupling and high directivity are achieved.

In recent years, with an increasing demand for miniaturization of communication equipment, a demand for miniaturization of directional couplers that are mounted on the communication equipment has also been increasing. In this respect, a configuration that seeks miniaturization by integrating a directional coupler with a board in place of a directional coupler made up of mounting components is conceivable.

However, it is difficult to integrate the existing directional coupler with a board in view of the following points. That is, in the existing directional coupler, only the capacitor provided in parallel with the secondary line improves directivity. If the element value of the capacitor is adjusted to improve characteristics, the element value may exceed an upper limit at or below which the capacitor is allowed to be integrated with a board. On the other hand, if the element value of the capacitor is limited to a value at or below the upper limit for miniaturization, an improvement in characteristics is insufficient.

SUMMARY OF THE INVENTION

Preferred embodiments of the present invention provide directional coupler-integrated boards, radio-frequency front-end circuits, and communication devices that each achieve both improved characteristics and miniaturization.

A directional coupler-integrated board according to a preferred embodiment of the present invention includes an input port, an output port, a coupling port, a directional coupler, a first capacitor, a second capacitor, an impedance element, a matching circuit, and a multilayer circuit board. The directional coupler includes a main line and a secondary line. One end of the main line is connected to the input port.

Another end of the main line is connected to the output port. The secondary line is electromagnetically coupled to the main line. One end of the secondary line is connected to the coupling port. The first capacitor is connected in parallel with the secondary line. The second capacitor connects another end of the secondary line to a ground. The impedance element connects the other end of the secondary line to the ground. The impedance element has an impedance lower than a normalized impedance at a predetermined frequency. The matching circuit is connected between the one end of the secondary line and the coupling port. The matching circuit matches an impedance at the coupling port to the normalized impedance at the predetermined frequency. The multilayer circuit board includes a plurality of laminated electrically insulating layers. The directional coupler is integrated with the multilayer circuit board.

In this manner, by providing the second capacitor, while characteristics (particularly, directivity characteristics) are improved, the element value of the first capacitor is limited. In addition, since the impedance element having an impedance lower than the normalized impedance at the predetermined frequency is provided, the directivity characteristics are improved. However, with the configuration including such an impedance element having an impedance lower than the normalized impedance, the impedance when viewed from the coupling port side is lower than the normalized impedance. In addition, since the second capacitor is provided, the impedance has a capacitive component. Since the matching circuit to match the impedance at the coupling port to the normalized impedance is provided, the return loss due to impedance mismatching at the coupling port is improved. Therefore, since the directional coupler-integrated board according to the present preferred embodiment includes the first capacitor, the second capacitor, the impedance element, the matching circuit, and the directional coupler integrated with the multilayer circuit board, the element values of the elements of the first capacitor, the second capacitor, the impedance element, and the matching circuit are limited to element values at which the elements are able to be integrated with the multilayer circuit board, and improved characteristics are achieved. That is, the directional coupler-integrated board that achieves both improved characteristics and miniaturization is obtained.

The first capacitor, the second capacitor, and the matching circuit may be further integrated with the multilayer circuit board.

Thus, as compared to the case in which these elements are mounting components, further miniaturization of the directional coupler-integrated board is achieved.

Each of the main line and the secondary line may be a pattern conductor disposed parallel or substantially parallel to a principal surface of the multilayer circuit board. The pattern conductor that is the main line and the pattern conductor that is the secondary line may face each other with at least a portion of the plurality of electrically insulating layers interposed between the pattern conductors.

Thus, the main line and the secondary line are electromagnetically coupled to each other with at least a portion of the electrically insulating layers interposed therebetween. Thus, the degree of electromagnetic coupling is adjusted by using the thickness, number of layers, material, or other factors, of at least a portion of the electrically insulating layers, interposed between the main line and the secondary line. Therefore, by adjusting these factors as needed, further improved characteristics of the directional coupler-integrated board are achieved.

Both of the pattern conductor that is the main line and the pattern conductor that is the secondary line may be disposed in an internal layer of the multilayer circuit board.

Thus, the effect of an external board or element on electromagnetic coupling between the main line and the secondary line is reduced, so the electromagnetic coupling is stabilized. Therefore, the directional coupler-integrated board having high reliability in characteristics is achieved. In addition, high flexibility of the arrangement layout is provided for surface electrodes connecting the multilayer circuit board to a mother board, an antenna element, or other components.

Each of the main line and the secondary line may be a pattern conductor disposed parallel or substantially parallel to a principal surface of the multilayer circuit board in an internal layer of the multilayer circuit board. The pattern conductor that is the main line and the pattern conductor that is the secondary line may be disposed in or on the same one of the plurality of electrically insulating layers.

Thus, a thin multilayer circuit board is provided. Therefore, further miniaturization (particularly, low profile) of the overall directional coupler-integrated board is achieved. The matching circuit may include an inductor and a third capacitor. The inductor connects the one end of the secondary line to the coupling port. The third capacitor connects one end of the inductor to the ground.

Thus, while the element values of the elements of the matching circuit are limited to upper limits at or below which the elements are able to be integrated with the multilayer circuit board, the number of the elements is reduced. Therefore, further miniaturization of the directional coupler-integrated board is achieved.

The third capacitor may connect the one end of the inductor to the ground, and the one end of the inductor may be on the coupling port side.

The third capacitor may connect the one end of the inductor to the ground, and the one end of the inductor may be on the secondary line side.

The first capacitor may be connected in parallel with a series connection circuit including the secondary line and the inductor.

Thus, as compared to the configuration in which the first capacitor is connected in parallel with only the secondary line, at least one of the element value (capacitance) of the first capacitor and the element value (inductance) of the inductor is further reduced. Therefore, further miniaturization of the directional coupler-integrated board is achieved.

A directional coupler-integrated board according to a preferred embodiment of the present invention includes an input port, an output port, and a coupling port; a directional coupler including a main line and a secondary line, one end of the main line being connected to the input port, another end of the main line being connected to the output port, the secondary line being electromagnetically coupled to the main line, one end of the secondary line being connected to the coupling port; a first capacitor connected in parallel with the secondary line; a second capacitor connecting another end of the secondary line to a ground; an impedance element connecting the another end of the secondary line to the ground; and a matching circuit connected between the one end of the secondary line and the coupling port.

A radio-frequency front-end circuit according to a preferred embodiment of the present invention includes a directional coupler-integrated board according to a preferred embodiment of the present invention, a switch circuit, and a plurality of filters. The switch circuit includes a common terminal and a plurality of selection terminals. The common terminal is connected to the input port. The plurality of selection terminals is selectively connected to the common terminal. The plurality of filters is individually connected to the plurality of selection terminals.

Thus, the radio-frequency front-end circuit that achieves both improved characteristics and miniaturization is obtained.

A communication device according to a preferred embodiment of the present invention includes an RF signal processing circuit and a radio-frequency front-end circuit according to a preferred embodiment of the present invention. The RF signal processing circuit processes a radio-frequency signal that is transmitted or received by an antenna element. The radio-frequency front-end circuit transmits the radio-frequency signal between the antenna element and the RF signal processing circuit.

Thus, the communication device that achieves both improved characteristics and miniaturization is obtained.

With the directional coupler-integrated boards, the radio-frequency front-end circuits, and the communication devices according to preferred embodiments of the present invention, both improved characteristics and miniaturization are achieved.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
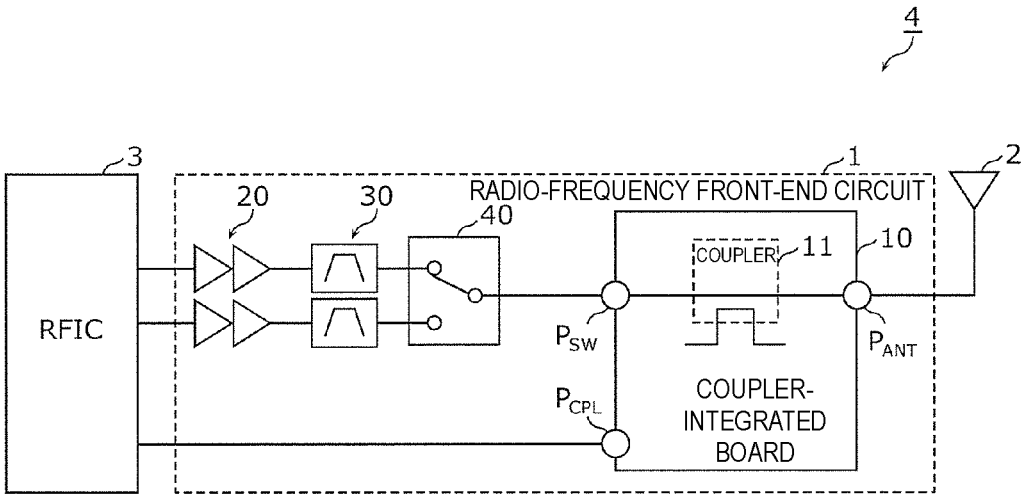
FIG. 1 is a diagram of a radio-frequency front-end circuit and its peripheral circuit according to a preferred embodiment of the present invention.

Hereinafter, preferred embodiments of the present invention will be described in detail with reference to an Example and the drawings. Preferred embodiments that will be described below describe a comprehensive or specific example. Numeric values, shapes, materials, elements, disposition and connection structures of the elements, and other features and elements, that will be described below are illustrative, and do not limit the present invention. Of the elements in the following preferred embodiments, the elements not included in the independent claims will be described as optional elements. In addition, the size or size ratio of elements shown in the drawings is not necessarily strict. The same reference signs denote the same or substantially the same components in the drawings, and redundant description may be omitted or simplified.

A directional coupler-integrated board according to a preferred embodiment of the present invention is disposed at a front-end portion of a communication device, such as a cellular phone, for example. The directional coupler-integrated board is disposed in, for example, a radio-frequency front-end circuit of a multiband communication device. A directional coupler is also referred to as coupler. Therefore, in the following description, the directional coupler is referred to as coupler, and the directional coupler-integrated board with the integrated coupler is referred to as coupler-integrated board.

FIG. 1 is a diagram of a radio-frequency front-end circuit 1 and its peripheral circuit according to the present preferred embodiment. In the diagram, an antenna element 2 and an RFIC 3 are shown. The antenna element 2 and the RFIC 3 define a communication device 4 together with the radio-frequency front-end circuit 1. The communication device 4, for example, communicates with another communication device using radio-frequency signals in Bands (frequency bands) defined in Third Generation Partnership Project (3GPP). In the present preferred embodiment, the communication device 4 preferably communicates with another communication device using a radio-frequency signal in a low band (for example, about 704 MHz-about 960 MHz) and a radio-frequency signal in a high band (for example, about 1710 MHz-about 2170 MHz) (cellular signals). The communication device 4 incorporates the antenna element 2 in the present preferred embodiment. However, the communication device 4 does not always need to incorporate the antenna element 2.

The antenna element 2 is preferably, for example, a multiband antenna that transmits or receives radio-frequency signals.

The RFIC 3 is an RF signal processing circuit that processes radio-frequency signals that are transmitted or received by the antenna element 2. Specifically, the RFIC 3 processes a transmission signal input from a baseband signal processing circuit (not shown) by up-conversion, for example, and outputs a radio-frequency signal (radio-frequency transmission signal) generated through the signal processing to a transmission-side signal path of the radio-frequency front-end circuit 1. In addition, the RFIC 3 processes a radio-frequency signal (radio-frequency reception signal) input from the antenna element 2 via a reception-side signal path (not shown) of the radio-frequency front-end circuit 1 by down-conversion, for example, and outputs a reception signal generated through the signal processing to the baseband signal processing circuit.

The radio-frequency front-end circuit 1 transmits a radio-frequency signal between the antenna element 2 and the RFIC 3. Specifically, the radio-frequency front-end circuit 1 transmits a radio-frequency signal (radio-frequency transmission signal) output from the RFIC 3 to the antenna element 2 via the transmission-side signal path. In addition, the radio-frequency front-end circuit 1 transmits a radio-frequency signal (radio-frequency reception signal) received by the antenna element 2 to the RFIC 3 via the reception-side signal path (not shown).

In the present preferred embodiment, the radio-frequency front-end circuit 1 includes a coupler-integrated board 10, a transmission amplifier circuit group 20, a filter group 30, and a switch circuit 40.

The coupler-integrated board 10 includes the integrated coupler 11. The coupler-integrated board 10 transmits a radio-frequency signal, input to an input port, to an output port, and outputs, from a coupling port, a radio-frequency signal having an electric power proportional to an electric power of the radio-frequency signal that is transmitted from the input port to the output port. In the present preferred embodiment, the input port is a switch port $P_{SW}$ that is a terminal connected to the switch circuit 40, the output port is an antenna port $P_{ANT}$ that is a terminal connected to the antenna element 2, and the coupling port is a coupling port $P_{CPL}$ that is a terminal connected to the RFIC 3. The details of the coupler-integrated board 10 will be described below.

The transmission amplifier circuit group 20 includes amplifier circuits that are individually associated with a plurality of bands. Specifically, each of the amplifier circuits includes one or more power amplifiers that amplify a radio-frequency transmission signal output from the RFIC 3 in electric power. In the present preferred embodiment, each of the amplifier circuits includes two-stage power amplifiers connected in multiple stages (cascading connection).

The filter group 30 includes filters that are individually associated with a plurality of bands. The filter group 30 filters radio-frequency signals amplified by the transmission amplifier circuit group 20 with the associated frequency bands. In the present preferred embodiment, the filter group 30 includes a filter having a low frequency band (low cellular band) as a pass band and a filter having a high frequency band (high cellular band) as a pass band.

The switch circuit 40 includes a common terminal and a plurality of selection terminals (for example, two selection terminals in the present preferred embodiment). The common terminal is connected to the switch port $P_{SW}$ (input port) of the coupler-integrated board 10. The plurality of selection terminals are selectively connected to the common terminal. The plurality of selection terminals are individually connected to the plurality of associated filters that define the filter group 30. The switch circuit 40 connects any one of the plurality of selection terminals to the common terminal in response to a control signal from a control unit, such as the RFIC 3. The number of the selection terminals that are connected to the common terminal is not limited to one, and may be a plurality of connection terminals.

The radio-frequency front-end circuit 1 amplifies a radio-frequency signal (radio-frequency transmission signal) input from the RFIC 3 using a predetermined one of the power amplifiers, filters the radio-frequency signal with a predetermined one of the filters, and then outputs the radio-frequency signal to the antenna element 2. The communication device 4 including the radio-frequency front-end circuit 1, the antenna element 2, and the RFIC 3 detects an electric power of a radio-frequency transmission signal using an electric power of a radio-frequency signal output from the coupling port $P_{CPL}$. Thus, the communication device 4 is able to, for example, control an electric power output from the power amplifier based on the detected electric power.

Next, the details of the coupler-integrated board 10 according to the present preferred embodiment will be described.

Figure 2:
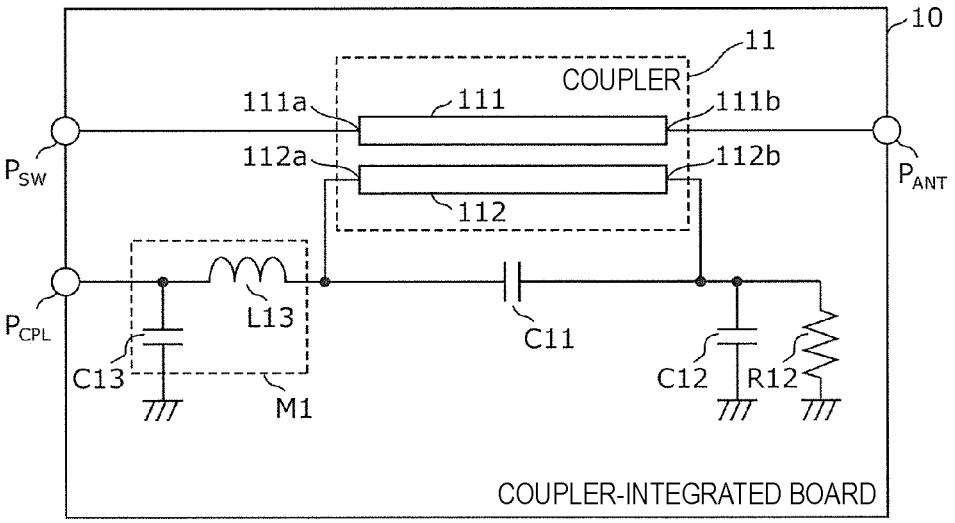
FIG. 2 is a circuit diagram of a coupler-integrated board according to a preferred embodiment of the present invention.

FIG. 2 is a circuit diagram of the coupler-integrated board 10.

As shown in FIG. 2, the coupler-integrated board 10 includes the coupler 11, a capacitor C11, a capacitor C12, a resistance element R12, and a matching circuit M1. The coupler 11 includes a main line 111 and a secondary line 112. The matching circuit M1 includes a capacitor C13 and an inductor L13.

The main line 111 is a transmission line. One end 111*a* of the main line 111 is connected to the switch port $P_{SW}$ (input port). The other end 111*b* of the main line 111 is connected to the antenna port $P_{ANT}$ (output port).

The secondary line 112 is a transmission line. The secondary line 112 is electromagnetically coupled to the main line 111. One end 112*a* of secondary line 112 is connected to the coupling port $P_{CPL}$ (coupling port). Electromagnetic coupling means capacitive coupling and magnetic coupling. That is, the main line 111 and the secondary line 112 are capacitively coupled to each other by a capacitance that is generated therebetween and are magnetically coupled to each other by a mutual inductance that acts therebetween.

In the coupler 11 including the main line 111 and the secondary line 112, a radio-frequency signal having an electric power proportional to an electric power of a radio-frequency signal flowing from the one end 111*a* of the main line 111 to the other end 111*b* of the main line 111 flows from the other end 112*b* of the secondary line 112 to the one end 112*a* of the secondary line 112, and is output.

The capacitor C11 is a first capacitor connected in parallel with the secondary line 112. In the present preferred embodiment, the capacitor C11 connects (bridges) the one end 112*a* of the secondary line 112 to the other end 112*b* of the secondary line 112. The capacitor C11 defines an LC resonance circuit together with an inductance component of the main line 111 and an inductance component of the secondary line 112. The LC resonance circuit resonates with a radio-frequency signal that is transmitted from the switch port $P_{SW}$ to the antenna port $P_{ANT}$. For example, where the frequency of the radio-frequency signal (that is a predetermined frequency, such as the operating frequency of the coupler 11) is f and a total inductance component of the main line 111 and secondary line 112 is L, the element value (capacitance) $C_{11}$ of the capacitor C11 is preferably set, for example, to be smaller than an element value that satisfies $f=1/(2\pi\sqrt{(LC_{11})})$.

The capacitor C12 is a second capacitor that connects the other end 112*b* of the secondary line 112 to a ground.

The resistance element R12 is an impedance element that connects the other end 112*b* of the secondary line 112 to the ground. In other words, the resistance element R12 (impedance element) is a terminal resistor of the coupler 11, and is specifically a terminal resistor of the other end 112*b* of the secondary line 112. In the coupler-integrated board 10, a parallel connection circuit including the resistance element R12 and the capacitor C12 is connected to a node in a path that connects the other end 112*b* of the secondary line 112 to the capacitor C11.

The resistance element R12 is an impedance element of which the impedance is lower than a normalized impedance at the operating frequency (predetermined frequency) of the coupler 11. In the present preferred embodiment, the operating frequency of the coupler 11 preferably falls within a frequency band including the pass bands of the filter group 30, and the normalized impedance is about 50Ω, for example.

The operating frequency and normalized impedance of the coupler 11 are not limited to these values. The impedance element that connects the other end 112*b* of the secondary line 112 to the ground is not limited to the resistance element R12. The impedance element may be any impedance element of which the impedance is lower than the normalized impedance at the operating frequency of the coupler 11. For example, the impedance element may be an inductor.

The matching circuit M1 is connected between the one end 112*a* of the secondary line 112 and the coupling port $P_{CPL}$ and matches the impedance at the coupling port $P_{CPL}$ to the normalized impedance at the operating frequency of the coupler 11. That is, in the coupler-integrated board 10, the matching circuit M1 is connected to a node in a path that connects the one end 112*a* of the secondary line to the capacitor C11. Matching the impedance to the normalized impedance not only includes completely matching the impedance to the normalized impedance but also matching the impedance to an impedance close to the normalized impedance, and also includes, for example, matching the return loss to within a range lower than or equal to about 15 dB.

Specifically, the matching circuit M1 includes an inductor L13 and a capacitor C13 (third capacitor). The inductor L13 connects the one end 112*a* of the secondary line 112 to the coupling port $P_{CPL}$. The capacitor C13 connects one end of the inductor L13 to the ground. In the present preferred embodiment, the capacitor C13 connects the coupling port $P_{CPL}$-side end of the inductor L13 to the ground.

The coupler-integrated board 10 having such a circuit configuration preferably includes a multilayer circuit board with the integrated coupler 11. This will be further described with reference to FIG. 3.

Figure 3:
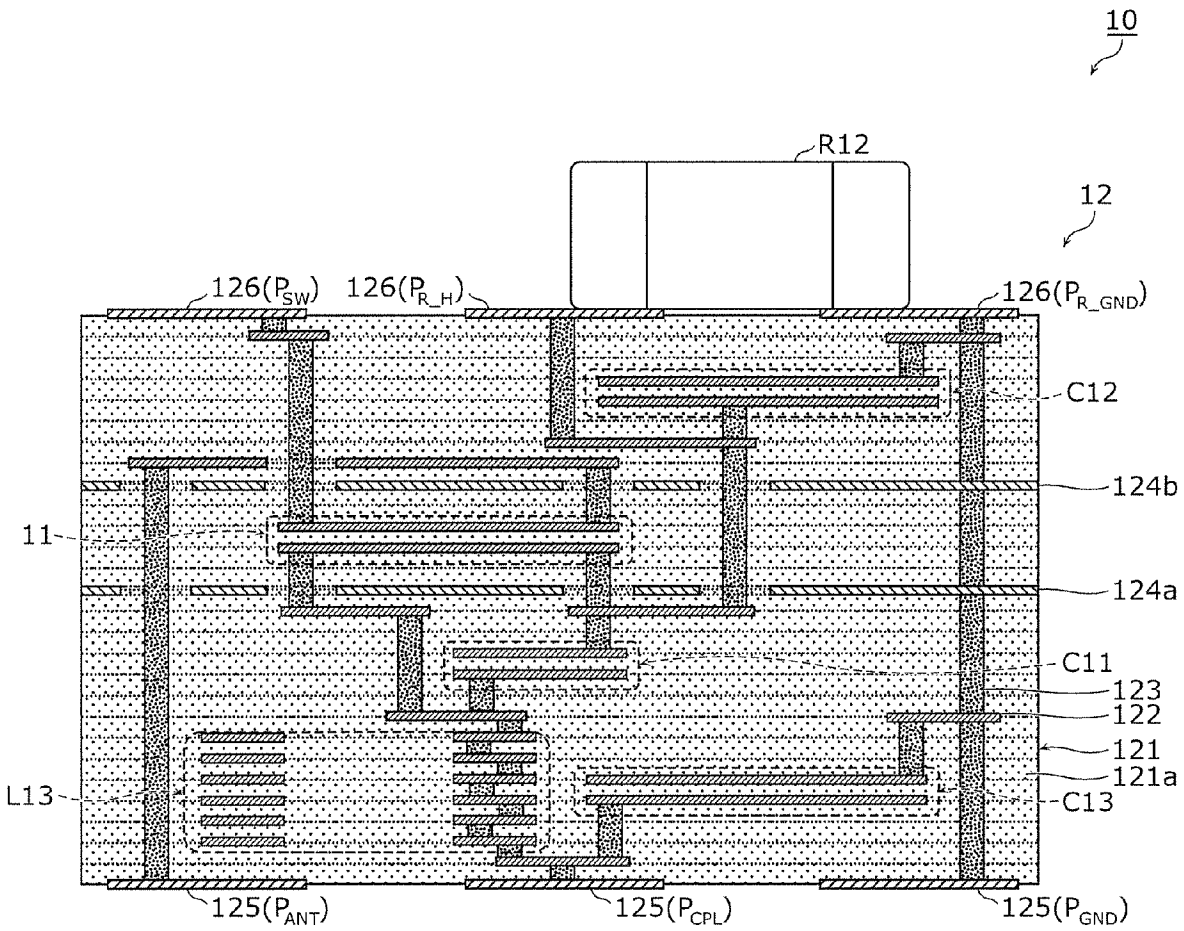
FIG. 3 is a diagram schematically showing the cross-sectional structure of a coupler-integrated board according to a preferred embodiment of the present invention.

FIG. 3 is a diagram schematically showing the cross-sectional structure of the coupler-integrated board 10 according to the present preferred embodiment. In FIG. 3, for the sake of simple and clear illustration, elements that are in other cross sections may be shown in the same diagram. In the present preferred embodiment, the resistance element R12 that is a mounting component (chip component) is shown in side view. In the diagram, for the sake of convenience, boundaries of base material layers (described later) are represented by dashed lines.

As shown in FIG. 3, the coupler-integrated board 10 includes the multilayer circuit board 12 and the resistance element R12. The coupler 11 is integrated with the multilayer circuit board 12. The resistance element R12 is mounted on the multilayer circuit board 12. In the present preferred embodiment, the capacitor C11 (first capacitor), the capacitor C12 (second capacitor), and the matching circuit M1 (that is, the capacitor C13 and the inductor L13) are further integrated with the multilayer circuit board 12.

The multilayer circuit board 12 includes a plurality of laminated electrically insulating layers (27 base material layers 121*a*). The coupler 11 is integrated with the multilayer circuit board 12. Specifically, the multilayer circuit board 12 includes a multilayer element assembly 121 and various conductors. The multilayer element assembly 121 includes the plurality of laminated base material layers 121*a*. The various conductors are used to provide the circuit configuration of the coupler-integrated board 10. The various conductors include, for example, pattern conductors 122, via conductors 123, and ground conductors 124*a*, 124*b*. The pattern conductors 122 are in-plane conductors provided in the multilayer circuit board along a principal surface of the multilayer circuit board 12. The via conductors 123 are interlayer connection conductors provided in a direction perpendicular or substantially perpendicular to the principal surface. The ground conductors 124*a*, 124*b* are internal layers provided substantially over an entirety of the electrically insulating layers in the multilayer circuit board along the principal surface of the multilayer circuit board 12. In addition, the multilayer circuit board 12 includes surface electrodes 125 on, for example, a bottom surface. The surface electrodes 125 are used to mount the multilayer circuit board 12 on a mother board, or other suitable structure. The multilayer circuit board 12 includes surface electrodes 126 on, for example, a top surface. The surface electrodes 126 are, for example, used to mount a mounting component, such as the resistance element R12.

For example, non-magnetic ferrite ceramics or electrically insulating glass-ceramics containing alumina and glass as main ingredients may preferably be used as the base material layers 121*a*. Magnetic ferrite ceramics may also be used as the base material layers 121*a*. For example, ferrite preferably contains an iron oxide as a main ingredient and contains at least one or more of zinc, nickel, and copper. For example, low temperature cofired ceramics (LTCC) of which the firing temperature is lower than or equal to the melting point of silver may preferably be used as ceramics. Thus, the various conductors may preferably be made of a metal or alloy containing silver as a main ingredient, for example. Therefore, the multilayer circuit board 12 is, for example, fired in an oxidizing atmosphere, such as air. In addition, for example, a metal or alloy containing silver as a main ingredient may preferably be used for the various conductors.

The base material layers 121*a* are not limited to the above-described materials. For example, a thermoplastic resin, such as polyimide, may be used as the base material layers 121*a*. The various conductors are not limited to the above-described materials. For example, a metal or alloy containing copper as a main ingredient may be used as the various conductors.

In the present preferred embodiment, the coupler 11, the capacitors C11 to C13, the inductor L13, and wires that connect these elements are defined by the pattern conductors 122 and the via conductors 123. For example, the coupler 11 is defined by the pair of facing long pattern conductors 122, each of the capacitors C11 to C13 is defined by the pair of facing rectangular or substantially rectangular pattern conductors 122, and the inductor L13 is defined by connecting the end portions of the plurality of coil-shaped pattern conductors 122 through the via conductors 123. The antenna port $P_{ANT}$ (output terminal), the coupling port $P_{CPL}$ (coupling terminal), and a ground terminal $P_{GND}$ are defined by the bottom surface-side surface electrodes 125. The switch port $P_{SW}$ (input terminal) and mounting terminals $P_{R_H}$, $P_{R_GND}$ are defined by the top surface-side surface electrodes 126. The mounting terminals $P_{R_H}$, $P_{R_GND}$ are used to mount the resistance element R12.

That is, in the present preferred embodiment, each of the main line 111 and the secondary line 112 of the coupler 11 is the pattern conductor 122 disposed parallel or substantially parallel to the principal surface of the multilayer circuit board 12. The pattern conductor 122 defining the main line 111 and the pattern conductor 122 defining the secondary line 112 face each other with at least a portion of the plurality of electrically insulating layers (one of the plurality of base material layers 121*a*) interposed therebetween. Therefore, the main line 111 and the secondary line 112 are electromagnetically coupled to each other in the multilayer circuit board 12. Specifically, the main line 111 and the secondary line 112 are parallel or substantially parallel to each other, and overlap each other when viewed in the lamination direction of the multilayer circuit board 12.

In the present preferred embodiment, both of the main line 111 and the secondary line 112 are provided in the internal layers of the multilayer circuit board 12. That is, each of the pattern conductor 122 defining the main line 111 and the pattern conductor 122 defining the secondary line 112 is sandwiched by one or more of the base material layers 121*a* on each side in the lamination direction.

In the present preferred embodiment, the pattern conductor 122 defining the main line 111 and the pattern conductor 122 defining the secondary line 112 are disposed between the ground conductors 124*a*, 124*b* on both sides in the lamination direction. With this configuration, isolation between the main line 111 or the secondary line 112 and another transmission line or element is improved, such that unnecessary electromagnetic coupling between these components is reduced.

The line width, length, and other specifications, of each of the pattern conductor 122 defining the main line 111 and the pattern conductor 122 defining the secondary line 112 may be determined as needed depending on specifications required of the coupler 11, such as a degree of coupling, the permittivity of each base material layer 121*a*, and other specification, for example.

The configuration of the coupler-integrated board 10 is described up here; however, the configuration of the coupler-integrated board 10 is not limited to the above-described configuration.

For example, the number of the base material layers 121*a* between the pattern conductor 122 defining the main line 111 and the pattern conductor 122 defining the secondary line 112 is not limited to the above-described number. For example, the number of the base material layers 121*a* may be determined as needed depending on specifications required of the coupler 11, such as a degree of coupling, the permittivity of each base material layer 121*a*, and other specifications, for example.

For example, one of the main line 111 and the secondary line 112 may be provided on the principal surface of the multilayer circuit board 12. That is, the one of the main line 111 and the secondary line 112 does not always need to be integrated in the multilayer circuit board 12, and only the other line may be integrated in the multilayer circuit board 12.

The element value of which an element is enabled to be integrated with the multilayer circuit board 12 has an upper limit depending on, for example, materials from which the multilayer circuit board 12 is made. For this reason, in the present preferred embodiment, the resistance element R12 (impedance element) is preferably the mounting component. However, when a resistor having the element value of the resistance element R12 is integrated with the multilayer circuit board 12, the resistance element R12 may be integrated with the multilayer circuit board 12. That is, the resistance element R12 may be defined by the pattern conductors 122, the via conductors 123, and other suitable elements.

From the viewpoint of miniaturization, it is preferable that the capacitors C11 to C13 and the inductor L13 are integrated with the multilayer circuit board 12. However, at least one of the capacitors C11 to C13 and the inductor L13 does not always need to be integrated with the multilayer circuit board 12 and may be a mounting component.

Next, the characteristics of the coupler-integrated board 10 according to the present preferred embodiment will be described with reference to an Example.

A coupler-integrated board according to the Example has the configuration of the coupler-integrated board 10 according to the present preferred embodiment, and transmits a high-band cellular signal. The element values of the coupler-integrated board 10 are as follows.

Capacitor C11 (first capacitor): about 0.7 pF

Capacitor C12 (second capacitor): about 2.2 pF

Resistance element R12 (impedance element): about 30 Ω

Capacitor C13 (third capacitor): about 2.3 pF

Inductor L13: about 1.3 nH

Figure 4A:
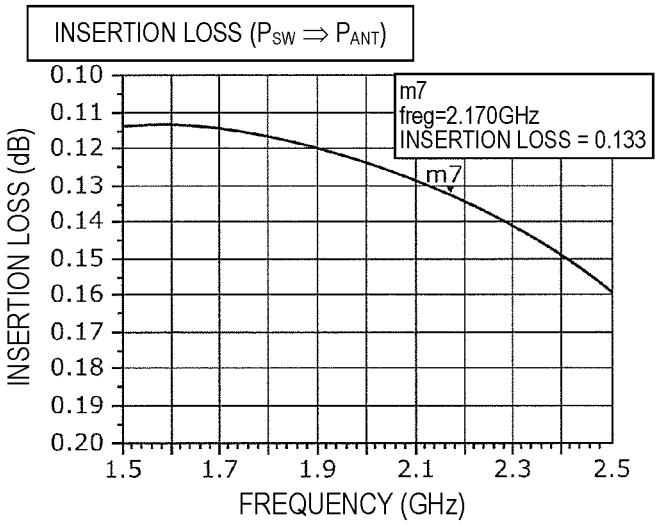
FIG. 4A is a graph showing the insertion loss characteristics of a coupler-integrated board according to an Example of a preferred embodiment of the present invention.
Figure 4B:
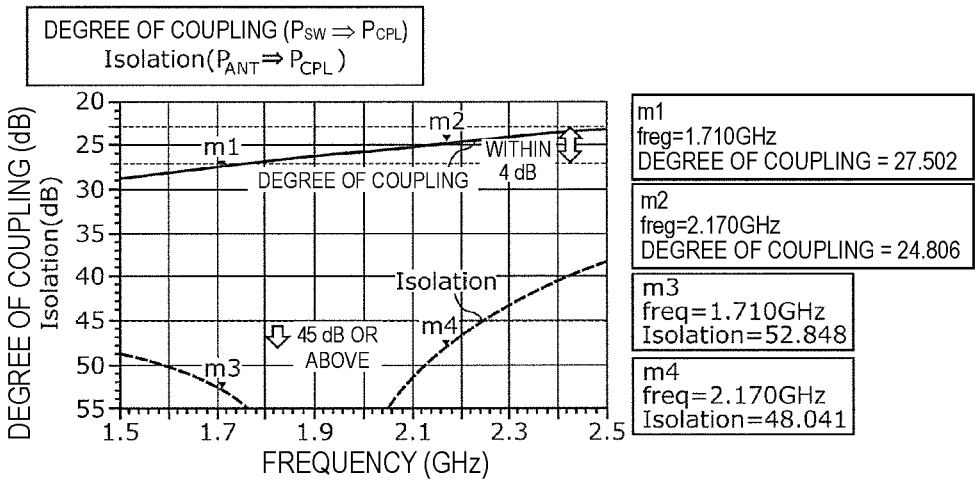
FIG. 4B is a graph showing the coupling characteristics and isolation characteristics of the coupler-integrated board according to the Example.
Figure 4C:
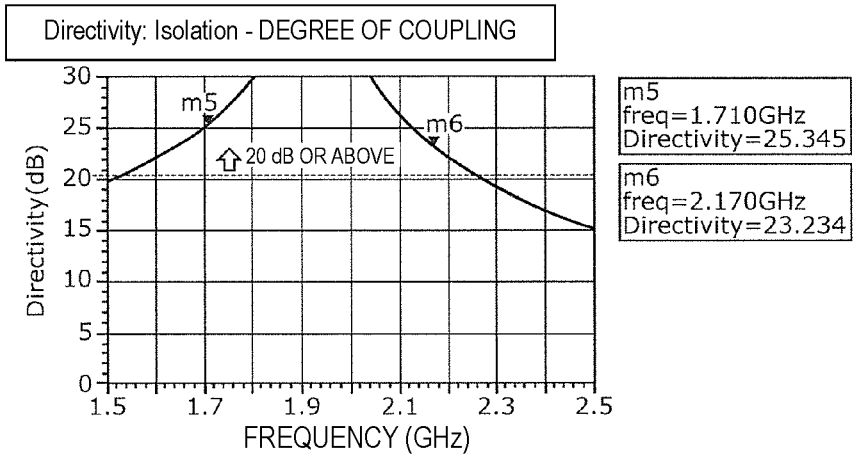
FIG. 4C is a graph showing the directivity characteristics of the coupler-integrated board according to the Example.
Figure 4D:
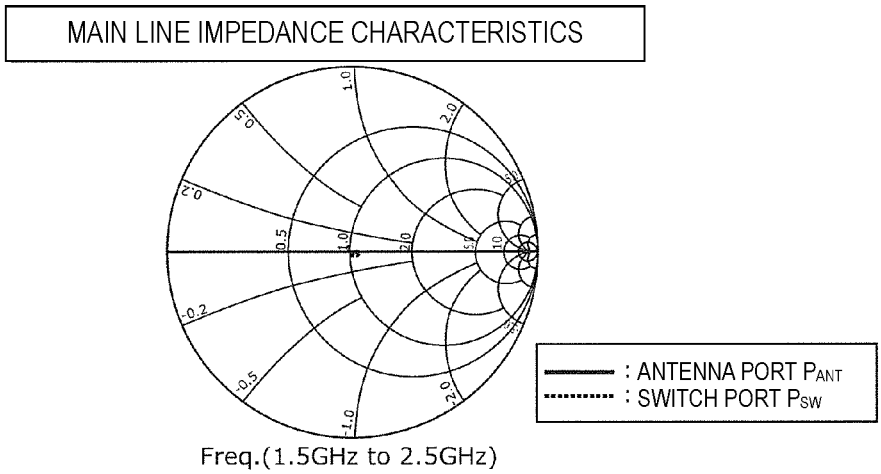
FIG. 4D is a Smith chart showing the impedance characteristics of a main line of the coupler-integrated board according to the Example.
Figure 4E:
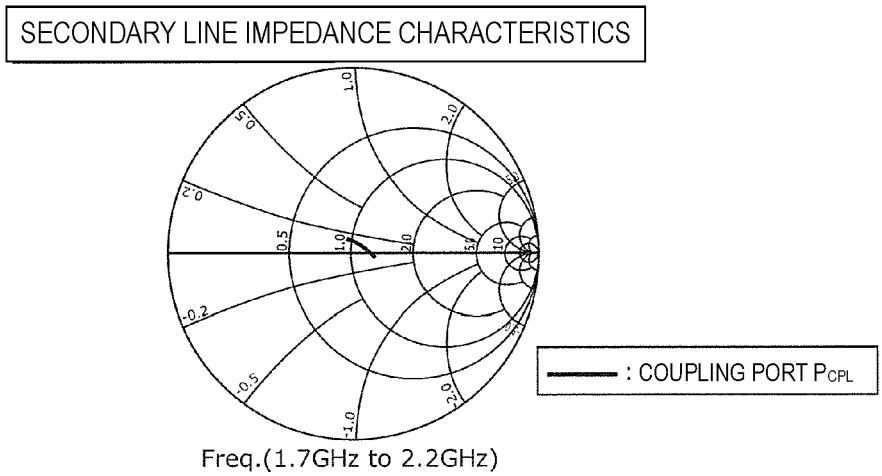
FIG. 4E is a Smith chart showing the impedance characteristics of a secondary line of the coupler-integrated board according to the Example.
Figure 4F:
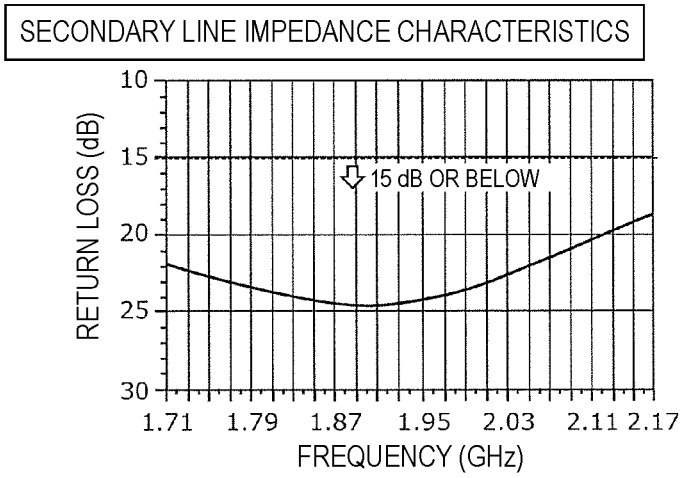
FIG. 4F is a graph showing the reflection characteristics of the secondary line of the coupler-integrated board according to the Example.

FIGS. 4A to 4F are graphs showing the characteristics of the coupler-integrated board according to the Example. Specifically, FIG. 4A is a graph showing the insertion loss characteristics of the coupler-integrated board according to the Example. FIG. 4B is a graph showing the coupling characteristics and isolation characteristics of the coupler-integrated board according to the Example. FIG. 4C is a graph showing the directivity characteristics of the coupler-integrated board according to the Example. FIG. 4D is a Smith chart showing the impedance characteristics of the main line 111 of the coupler-integrated board according to the Example where the impedance characteristics at the switch port $P_{SW}$ (input port) are represented by dotted line and the impedance characteristics at the antenna port $P_{ANT}$ (output port) are represented by solid line. FIG. 4E is a Smith chart showing the impedance characteristics of the secondary line 112 of the coupler-integrated board according to the Example where the impedance characteristics at the coupling port $P_{CPL}$ are shown. FIG. 4F is a graph showing the reflection characteristics of the secondary line 112 of the coupler-integrated board according to the Example where the reflection characteristics at the coupling port $P_{CPL}$ are shown.

The insertion loss characteristics mean the bandpass frequency characteristics (insertion loss) between the switch port $P_{SW}$ (input port) and the antenna port $P_{ANT}$ (output port). The coupling characteristics mean the frequency characteristics of the amount of coupling (degree of coupling) between the switch port $P_{SW}$ (input port) and the coupling port $P_{CPL}$. The isolation characteristics mean the frequency characteristics of the amount of coupling (isolation) between the antenna port $P_{ANT}$ (output port) and the coupling port $P_{CPL}$. The directivity characteristics mean the frequency characteristics of a difference obtained by subtracting the coupling characteristics from the isolation characteristics. The impedance characteristics mean the frequency characteristics of the impedance at each of the ports (the switch port $P_{SW}$ and the antenna port $P_{ANT}$ in FIG. 4D, and the coupling port $P_{CPL}$ in FIG. 4E). The reflection characteristics mean the reflection frequency characteristics (return loss) of input and output at each port (the coupling port $P_{CPL}$ in FIG. 4F).

In FIGS. 4A to 4C, a mark is added to at least one of a low pass band edge (about 1710 MHz) and a high pass band edge (about 2170 MHz). On the right side of each graph, a frequency at the mark m* (* represents a numeric value suffixed to m in the graph) in the graph and a numeric value at the mark are shown.

In Example, as shown in FIG. 4A, the insertion loss is lower than or equal to about 0.14 dB within the pass band. As shown in FIG. 4B, a variation in the degree of coupling is restricted to 4 dB or below within the pass band. Specifically, the degree of coupling is in the range of about 25.5±2.0 dB, and is smoothed. As shown in FIG. 4B, about 45 dB or higher isolation is ensured within the pass band. Based on this degree of coupling and isolation, as shown in FIG. 4C, about 20 dB or larger directivity is ensured. As shown in FIG. 4D, as for the main line 111, the impedance is matched to the normalized impedance (about 50Ω, for example) at any one of the switch port $P_{SW}$ and the antenna port $P_{ANT}$ within the pass band. As shown in FIG. 4E, for the secondary line 112 as well, the impedance is matched to the normalized impedance (about 50Ω, for example) at the coupling port $P_{CPL}$ within the pass band. Therefore, as shown in FIG. 4F, the return loss is smaller than or equal to about 15 dB within the pass band at the coupling port $P_{CPL}$.

In this manner, it is understood that the coupler-integrated board according to the Example achieves miniaturization and has good characteristics by integrating the coupler 11, the capacitors C11 to C13, and the inductor L13 with the multilayer circuit board 12.

As described above, the coupler-integrated board 10 according to the present preferred embodiment includes the capacitor C11 (first capacitor) connected in parallel with the secondary line 112. The coupler-integrated board 10 includes the capacitor C12 (second capacitor), the resistance element R12 (impedance element), and the multilayer circuit board 12. The capacitor C12 connects the other end 112*b* of the secondary line 112 to the ground. The resistance element R12 connects the other end 112*b* of the secondary line 112 to the ground. The coupler 11 is integrated with the multilayer circuit board 12. The coupler-integrated board 10 includes the matching circuit M1 connected between the one end 112*a* of the secondary line 112 and the coupling port $P_{CPL}$.

In this manner, in the present preferred embodiment, by providing the capacitor C12 (second capacitor), while the characteristics (particularly, the directivity characteristics) are improved, the element value of the capacitor C11 (first capacitor) is limited. Specifically, even with the configuration in which, of the capacitors C11, C12, only the capacitor C11 is provided, similarly improved characteristics to that of the present preferred embodiment is achieved. In this case, since the characteristics need to be improved with only one capacitor, design flexibility is low. Thus, it may be difficult to integrate the capacitor C11 with the multilayer circuit board 12, so it may interfere with miniaturization. In contrast to this, in the present preferred embodiment, by providing the capacitor C12, while design flexibility is ensured, the capacitors C11, C12 are integrated with the multilayer circuit board 12.

The mechanism to improve characteristics with the capacitor C12 is, for example, understood as follows. That is, an impedance that is added to the other end 112*b* of the secondary line 112 depends on the constant of the capacitor C12. Therefore, by adjusting the constant of the capacitor C12 as needed, it becomes easy to flow a radio-frequency signal at a specific frequency to a terminal resistor (in the present preferred embodiment, the resistance element R12). As a result, a radio-frequency signal that is transmitted from the antenna port $P_{ANT}$ (output port) to the coupling port $P_{CPL}$ is reduced, such that isolation is increased (the isolation characteristics are improved). That is, improved directivity characteristics are achieved.

In the present preferred embodiment, since the resistance element R12 (impedance element) having an impedance lower than the normalized impedance at the predetermined frequency (lower than about 50Ω, for example, at the operating frequency of the coupler 11 in the present preferred embodiment) is provided, the directivity characteristics are improved. In general, when the other end 112*b* of the secondary line 112 is connected to another port, such as an isolation port, a system between the other end 112*b* of the secondary line and the other port is designed as a normalized impedance system to match the impedance at the other port. Therefore, when the other port is not used, the other port is terminated by an impedance element, such as a terminal resistor, having an impedance equivalent or substantially equivalent to the normalized impedance at the predetermined frequency. In this respect, the inventor of preferred embodiments of the present application discovered that, when the other port was not used, that is, in the case of a three-port configuration (an input port, an output port, and a coupling port), instead of a four-port configuration including another, port directivity characteristics were improved by setting the impedance of the impedance element to a value lower than the normalized impedance at the predetermined frequency.

However, in the configuration including such an impedance element having an impedance lower than the normalized impedance, the impedance when viewed from the coupling port $P_{CPL}$ side is lower than the normalized impedance. In addition, since the capacitor C12 is provided, the impedance has a capacitive component. In the present preferred embodiment, since the matching circuit M1 to match the impedance at the coupling port $P_{CPL}$ to the normalized impedance is provided between the one end 112*a* of the secondary line 112 and the coupling port $P_{CPL}$, the return loss due to impedance mismatching at the coupling port $P_{CPL}$ is improved (reduced).

In this respect, for example, for the purpose of smoothing a degree of coupling in a wide band, it is conceivable that a low pass filter including an inductor connecting the one end 112*a* of the secondary line 112 to the coupling port $P_{CPL}$ and a capacitor connecting the ground to a node in a path connecting the inductor to the coupling port $P_{CPL}$ is provided. However, with such a configuration, the element value of each of the elements that define the low pass filter easily increases, such that it may be difficult to integrate the low pass filter with the multilayer circuit board 12.

In contrast to this, in the present preferred embodiment, the elements that define the matching circuit M1 to improve (reducing) the return loss are provided between the one end 112*a* of the secondary line 112 and the coupling port $P_{CPL}$. Therefore, by limiting the element values of the elements, the elements are able to be integrated with the multilayer circuit board 12.

Therefore, since the coupler-integrated board 10 according to the present preferred embodiment includes the capacitors C11, C12, the resistance element R12, the matching circuit M1, and the coupler 11 integrated with the multilayer circuit board 12, the element values of the capacitors C11, C12, the resistance element R12, and the elements that define the matching circuit M1 are limited to element values at which the elements are able to be integrated with the multilayer circuit board 12, and improved characteristics are achieved. That is, the coupler-integrated board 10 that achieves both improved characteristics and miniaturization is obtained.

Specifically, in the present preferred embodiment, the capacitor C11 (first capacitor), the capacitor C12 (second capacitor), and the matching circuit M1 are integrated with the multilayer circuit board 12. Thus, as compared to the case in which these elements are mounting components, further miniaturization of the coupler-integrated board 10 is achieved.

In the present preferred embodiment, the pattern conductor 122 defining the main line 111 and the pattern conductor 122 defining the secondary line 112 are disposed with at least a portion of the base material layers 121*a* (electrically insulating layers) of the multilayer circuit board 12 interposed therebetween. Thus, the main line 111 and the secondary line 112 are electromagnetically coupled to each other with at least a portion of the base material layers 121*a* interposed therebetween. A technique to adjust the degree of electromagnetic coupling includes a technique to adjust the distance between the main line 111 and the secondary line 112 and a technique to adjust the inductance value by adjusting the length, width, or other specifications, of each of the main line 111 and the secondary line 112. In this respect, in the present preferred embodiment, the degree of electromagnetic coupling is able to be adjusted through the thickness, number of layers, material, or other factors, of at least a portion of the base material layers 121*a*, interposed between the main line 111 and the secondary line 112. Therefore, by adjusting these factors as needed, further improvement in the characteristics of the coupler-integrated board 10 is expected.

In the present preferred embodiment, the pattern conductor 122 defining the main line 111 and the pattern conductor 122 defining the secondary line 112 are both disposed in the internal layers of the multilayer circuit board 12. That is, the pattern conductors 122 are not exposed from the multilayer circuit board 12. Thus, the effect of an external board or element on electromagnetic coupling between the main line 111 and the secondary line 112 is reduced, such that the electromagnetic coupling is stabilized. Therefore, the coupler-integrated board 10 having high reliability in characteristics is obtained. In addition, high flexibility of the arrangement layout is provided for the surface electrodes 125, 126 connecting the multilayer circuit board 12 to a mother board, the antenna element 2, or other components.

In the present preferred embodiment, the matching circuit M1 includes the inductor L13 and the capacitor C13 (third capacitor). The inductor L13 connects the one end 112*a* of the secondary line 112 to the coupling port $P_{CPL}$. The capacitor C13 connects the one end of the inductor L13 to the ground. Thus, while the element values of the elements defining the matching circuit M1 are limited to upper limits at or below which the elements are able to be integrated with the multilayer circuit board 12, the number of the elements is reduced. Therefore, further miniaturization of the coupler-integrated board 10 is achieved.

In the above-described preferred embodiment, the capacitor C13 (third capacitor) connects the coupling port $P_{CPL}$-side end of the inductor L13 to the ground. However, the capacitor C13 only needs to connect one end of the inductor L13 to the ground, and a connection relationship is not limited to the above-described connection relationship.

Figure 5:
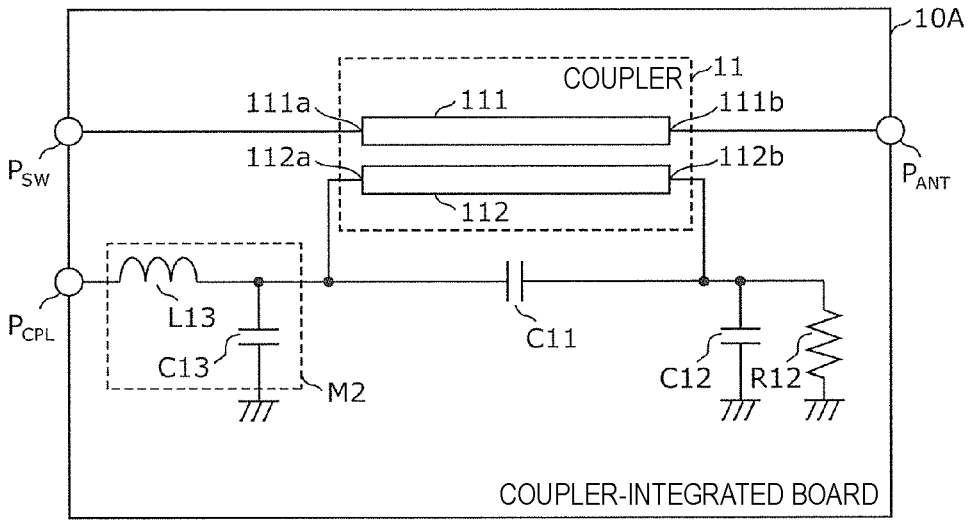
FIG. 5 is a circuit diagram of a coupler-integrated board according to a first alternative preferred embodiment of the present invention.

FIG. 5 is a circuit diagram of a coupler-integrated board 10A according to a first alternative preferred embodiment of the present invention.

The coupler-integrated board 10A shown in FIG. 5 differs from the coupler-integrated board 10 according to the above-described preferred embodiment in that a matching circuit M2 is provided instead of the matching circuit M1 and the capacitor C13 connects the secondary line 112-side end of the inductor L13 to the ground. That is, the capacitor C13 connects the ground to a node in a path that connects the inductor L13 to the one end 112*a* of the secondary line 112.

With the coupler-integrated board 10A according to the present alternative preferred embodiment, the same or similar advantageous effects to those of the above-described preferred embodiment are obtained.

In the above-described preferred embodiment, the capacitor C11 (first capacitor) connects the one end 112*a* of the secondary line 112 to the other end 112*b* of the secondary line 112. However, the capacitor C11 only needs to be connected in parallel with the secondary line 112, and a connection relationship is not limited to the above-described connection relationship.

Figure 6:
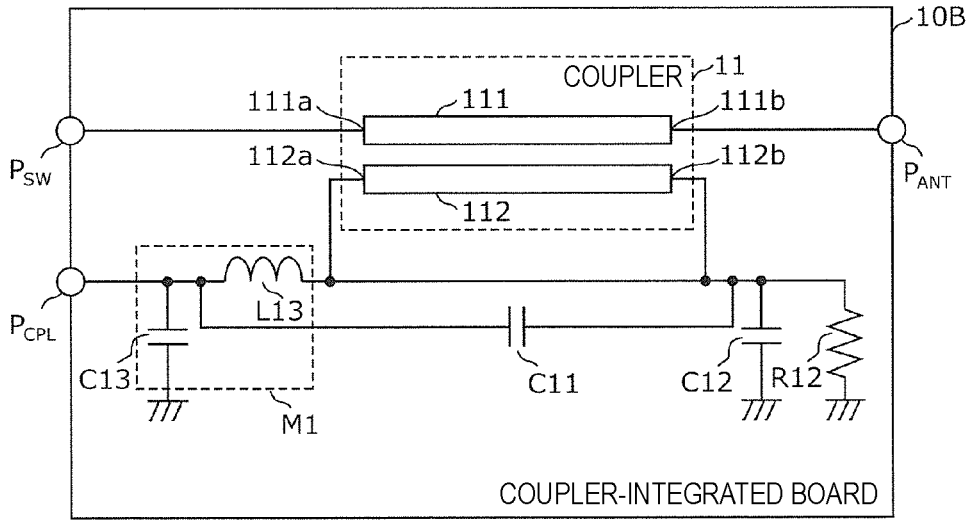
FIG. 6 is a circuit diagram of a coupler-integrated board according to a second alternative preferred embodiment of the present invention.

FIG. 6 is a circuit diagram of a coupler-integrated board 10B according to a second alternative preferred embodiment of the present invention.

The coupler-integrated board 10B shown in FIG. 6 differs from the coupler-integrated board 10 according to the above-described preferred embodiment in that the capacitor C11 is connected in parallel with a series connection circuit including of the secondary line 112 and the inductor L13. One end of the capacitor C11 is specifically connected to a node in a path that connects the coupling port $P_{CPL}$ to the inductor L13. More specifically, one end of the capacitor C11 is connected to a node closer to the inductor L13 than a node in the path, to which the capacitor C13 is connected. Alternatively, the one end of the capacitor C11 may be connected to a node closer to the coupling port $P_{CPL}$ than the node in the path, to which the capacitor C13 is connected.

With the coupler-integrated board 10B according to the present alternative preferred embodiment, the same or similar advantageous effects to those of the above-described preferred embodiment and the first alternative preferred embodiment are obtained.

In addition, according to the present alternative preferred embodiment, the capacitor C11 is connected in parallel with the series connection circuit including the secondary line 112 and the inductor L13, such that, as compared to the configuration that the capacitor C11 is connected in parallel with only the secondary line 112, at least one of the element value (capacitance) of the capacitor C11 and the element value (inductance) of the inductor L13 is able to be further reduced. Therefore, further miniaturization of the coupler-integrated board 10B is possible.

The coupler-integrated board (directional coupler-integrated board) according to the above-described preferred embodiment of the present invention is described with reference to the preferred embodiment and alternative preferred embodiments. However, the present invention is not limited to the above-described preferred embodiment or alternative preferred embodiments. The present invention also encompasses other preferred embodiments provided by combining selected elements of the above-described preferred embodiments and alternative preferred embodiments, alternative preferred embodiments obtained by applying various modifications that are conceived of by persons skilled in the art to the above-described preferred embodiments or alternative preferred embodiments without departing from the scope of the present invention, and various devices that include the coupler-integrated board according to the present invention.

Preferred embodiments of the present invention also encompass, for example, a radio-frequency front-end circuit including a coupler-integrated board according to a preferred embodiment of the present invention and a communication device including a coupler-integrated board according to a preferred embodiment of the present invention. With such a radio-frequency front-end circuit and a communication device, since the radio-frequency front-end circuit and the communication device each include a coupler-integrated board according to a preferred embodiment of the present invention, both improved characteristics and miniaturization are achieved.

For example, in the multilayer circuit board 12, the pattern conductor 122 that defines the capacitor C12-side electrode of the capacitor C11 and the pattern conductor 122 that defines the capacitor C11-side electrode of the capacitor C12 may be integrated. That is, these two electrodes may be defined by the single pattern conductor 122. With this configuration, further miniaturization (particularly, low profile) of the coupler-integrated board is achieved.

Similarly, in the first alternative preferred embodiment, the pattern conductor 122 that defines the capacitor C13-side electrode of the capacitor C11 and the pattern conductor 122 that defines the capacitor C11-side electrode of the capacitor C13 may be integrated.

The main line 111 and the secondary line 112 may be disposed in the same layer of the multilayer circuit board 12. That is, each of the main line 111 and the secondary line 112 may be defined by the pattern conductor 122 disposed parallel or substantially parallel to the principal surface of the multilayer circuit board 12 in the internal layers of the multilayer circuit board 12, and the pattern conductor 122 defining the main line 111 and the pattern conductor 122 defining the secondary line 112 may be disposed in the same one of the plurality of base material layers 121*a* (the plurality of electrically insulating layers). In other words, the pattern conductor 122 defining the main line 111 and the pattern conductor 122 defining the secondary line 112 are disposed next to each other in the lamination direction of the multilayer circuit board 12 in the above-described preferred embodiment. Alternatively, the pattern conductor 122 defining the main line 111 and the pattern conductor 122 defining the secondary line 112 may be disposed next to each other in a direction perpendicular or substantially perpendicular to the lamination direction (that is, a direction parallel or substantially parallel to the principal surface of the multilayer circuit board 12).

With this configuration, since the main line 111 and the secondary line 112 are each defined by the pattern conductor 122 on one of the internal layers of the multilayer circuit board 12, the same or similar advantageous effects to those of the above-described preferred embodiment are obtained. That is, the coupler-integrated board having high reliability in characteristics is obtained. In addition, high flexibility of the arrangement layout is provided for the surface electrodes connecting the multilayer circuit board 12 to a mother board, the antenna element, or other components.

Furthermore, with the above-described configuration, since the main line 111 and the secondary line 112 are disposed in the same one of the layers of the multilayer circuit board 12, the multilayer circuit board 12 that is thinner than that of the above-described preferred embodiment is achieved. Thus, further miniaturization (particularly, low profile) of the overall coupler-integrated board is achieved.

The above description is made by way of an example of the configuration in which the coupler 11 is used to detect the electric power of a radio-frequency transmission signal. Alternatively, the coupler 11 may be, for example, used to detect a reflected electric power of a radio-frequency transmission signal in the antenna element 2. With this configuration, the above-described switch port $P_{SW}$ (input port) is connected to the antenna element 2, and the above-described antenna port $P_{ANT}$ (output port) is connected to the switch circuit 40. That is, the input port and the output port may be connected as needed to components of the peripheral circuit of the coupler-integrated board, such as the antenna element 2 and the switch circuit 40, depending on an intended radio-frequency signal of which the electric power is detected.

The coupler 11 may be, for example, used to detect the electric power of a radio-frequency reception signal. That is, the coupler 11 is not limited to the transmission-system radio-frequency front-end circuit 1 including the power amplifiers. The coupler 11 may be used for a reception-system radio-frequency front-end circuit including low-noise amplifiers.

For example, in the radio-frequency front-end circuit 1 or the communication device 4, an inductor or a capacitor may be connected between the elements. The inductor may include a wire inductor defined by a wire that connects the elements.

Preferred embodiments of the present invention are widely usable in communication equipment, such as cellular phones, for example, as a small-sized coupler-integrated module having good characteristics, a small-sized radio-frequency front-end circuit having good characteristics, and a small-sized communication device having good characteristics.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A directional coupler-integrated board comprising:

an input port;

an output port;

a coupling port;

a directional coupler including a main line and a secondary line, one end of the main line being connected to the input port, another end of the main line being connected to the output port, the secondary line being electromagnetically coupled to the main line, one end of the secondary line being connected to the coupling port;

a first capacitor connected in parallel with the secondary line;

a second capacitor connecting another end of the secondary line to a ground;

an impedance element connecting the another end of the secondary line to the ground;

a matching circuit connected between the one end of the secondary line and the coupling port; and a multilayer circuit board including a plurality of laminated electrically insulating layers, the directional coupler being integrated with the multilayer circuit board.

2. A directional coupler-integrated board comprising:

an input port;

an output port;

a coupling port;

a directional coupler including a main line and a secondary line, one end of the main line being connected to the input port, another end of the main line being connected to the output port, the secondary line being electromagnetically coupled to the main line, one end of the secondary line being connected to the coupling port;

a first capacitor connected in parallel with the secondary line;

a second capacitor connecting another end of the secondary line to a ground;

an impedance element connecting the another end of the secondary line to the ground, the impedance element having an impedance lower than a normalized impedance at a predetermined frequency;

a matching circuit connected between the one end of the secondary line and the coupling port to match an impedance at the coupling port to the normalized impedance at the predetermined frequency; and a multilayer circuit board including a plurality of laminated electrically insulating layers, the directional coupler being integrated with the multilayer circuit board.

3. The directional coupler-integrated board according to claim 2, wherein the first capacitor, the second capacitor, and the matching circuit are integrated with the multilayer circuit board.

4. The directional coupler-integrated board according to claim 2, wherein each of the main line and the secondary line is defined by a pattern conductor disposed parallel or substantially parallel to a principal surface of the multilayer circuit board; and the pattern conductor defining the main line and the pattern conductor defining the secondary line face each other with at least a portion of the plurality of electrically insulating layers interposed between the pattern conductors.

5. The directional coupler-integrated board according to claim 4, wherein both of the pattern conductor defining the main line and the pattern conductor defining the secondary line are disposed in an internal layer of the multilayer circuit board.

6. The directional coupler-integrated board according to claim 2, wherein each of the main line and the secondary line is defined by a pattern conductor disposed parallel or substantially parallel to a principal surface of the multilayer circuit board in an internal layer of the multilayer circuit board; and the pattern conductor defining the main line and the pattern conductor defining the secondary line are disposed in a same one of the plurality of electrically insulating layers.

7. The directional coupler-integrated board according to claim 2, wherein the matching circuit includes:

an inductor connecting the one end of the secondary line to the coupling port; and a third capacitor connecting one end of the inductor to the ground.

8. The directional coupler-integrated board according to claim 7, wherein the third capacitor connects the one end of the inductor to the ground, and the one end of the inductor is on a side of the coupling port.

9. The directional coupler-integrated board according to claim 7, wherein the third capacitor connects the one end of the inductor to the ground, and the one end of the inductor is on a side of the secondary line.

10. The directional coupler-integrated board according to claim 7, wherein the first capacitor is connected in parallel with a series connection circuit including the secondary line and the inductor.

11. A radio-frequency front-end circuit comprising:

the directional coupler-integrated board according to claim 2;

a switch circuit including a common terminal and a plurality of selection terminals, the common terminal being connected to the input port, the plurality of selection terminals being selectively connected to the common terminal; and a plurality of filters individually connected to the plurality of selection terminals.

12. The radio-frequency front-end circuit according to claim 11, wherein the first capacitor, the second capacitor, and the matching circuit are integrated with the multilayer circuit board.

13. The radio-frequency front-end circuit according to claim 11, wherein each of the main line and the secondary line is defined by a pattern conductor disposed parallel or substantially parallel to a principal surface of the multilayer circuit board; and the pattern conductor defining the main line and the pattern conductor defining the secondary line face each other with at least a portion of the plurality of electrically insulating layers interposed between the pattern conductors.

14. The radio-frequency front-end circuit according to claim 13, wherein both of the pattern conductor defining the main line and the pattern conductor defining the secondary line are disposed in an internal layer of the multilayer circuit board.

15. The radio-frequency front-end circuit according to claim 11, wherein each of the main line and the secondary line is defined by a pattern conductor disposed parallel or substantially parallel to a principal surface of the multilayer circuit board in an internal layer of the multilayer circuit board; and the pattern conductor defining the main line and the pattern conductor defining the secondary line are disposed in a same one of the plurality of electrically insulating layers.

16. The radio-frequency front-end circuit according to claim 11, wherein the matching circuit includes:

an inductor connecting the one end of the secondary line to the coupling port; and a third capacitor connecting one end of the inductor to the ground.

17. The radio-frequency front-end circuit according to claim 16, wherein the third capacitor connects the one end of the inductor to the ground, and the one end of the inductor is on a side of the coupling port.

18. The radio-frequency front-end circuit according to claim 16, wherein the third capacitor connects the one end of the inductor to the ground, and the one end of the inductor is on a side of the secondary line.

19. The radio-frequency front-end circuit according to claim 16, wherein the first capacitor is connected in parallel with a series connection circuit including the secondary line and the inductor.

20. A communication device comprising:

an RF signal processing circuit to process a radio-frequency signal that is transmitted or received by an antenna element; and the radio-frequency front-end circuit according to claim 11; wherein the radio-frequency front-end circuit transmits the radio-frequency signal between the antenna element and the RF signal processing circuit.

* * * * *